US008200131B2

(12) United States Patent
Calamita et al.

(10) Patent No.: US 8,200,131 B2
(45) Date of Patent: Jun. 12, 2012

(54) USE OF REGISTRATION MARKS AND A LINEAR ARRAY SENSOR FOR IN-SITU RASTER OUTPUT SCANNER SCAN LINE NONLINEARITY DETECTION

(75) Inventors: James Patrick Calamita, Spencerport, NY (US); Michael J. Martin, Hamlin, NY (US)

(73) Assignee: Xerox Corporation, Norwalk, CT (US)

( * ) Notice: Subject to any disclaimer, the term of this patent is extended or adjusted under 35 U.S.C. 154(b) by 1022 days.

(21) Appl. No.: 12/145,765

(22) Filed: Jun. 25, 2008

(65) Prior Publication Data

US 2009/0322849 A1 Dec. 31, 2009

(51) Int. Cl.
*G03G 15/01* (2006.01)

(52) U.S. Cl. ..... 399/281

(58) Field of Classification Search ..... 399/38, 399/46, 49, 281, 297–302; 347/116
See application file for complete search history.

(56) References Cited

U.S. PATENT DOCUMENTS 4,611,901 A 9/1986 Kohyama et al.
4,660,059 A 4/1987 O'Brien
4,833,503 A 5/1989 Snelling
5,260,725 A * 11/1993 Hammond ..... 347/132
5,278,589 A 1/1994 Wong
5,278,625 A * 1/1994 Charnitski et al. ..... 399/178
5,365,074 A 11/1994 Genovese
5,418,556 A 5/1995 Andrews
5,438,354 A 8/1995 Genovese
6,178,031 B1 1/2001 Rauch et al.
6,300,968 B1 10/2001 Kerxhalli et al.
6,909,516 B1 * 6/2005 Hoover ..... 356/615
6,975,949 B2 12/2005 Mestha et al.
7,193,643 B2 3/2007 Zomorrodi et al.
2008/0063417 A1 3/2008 Elliot et al.

* cited by examiner

*Primary Examiner* — Hoan Tran
(74) *Attorney, Agent, or Firm* — Pillsbury Winthrop Shaw Pittman LLP

(57) ABSTRACT

A method for detecting, in-situ, a cross-process linearity error in an image printing system that prints on an image bearing surface movable in the process direction is provided. The method includes placing marking material to form of a row of registration marks on the image bearing surface, detecting a position in a cross-process direction of each registration mark in the row using a linear array sensor that extends in the cross-process direction, and determining a correction function with a processor using the positions of the registration marks as detected by the linear array sensor to compensate for an error in the positions in the cross-process direction of the registration marks. The row of registration marks extends in a cross-process direction transverse to the process direction.

20 Claims, 5 Drawing Sheets

USE OF REGISTRATION MARKS AND A LINEAR ARRAY SENSOR FOR IN-SITU RASTER OUTPUT SCANNER SCAN LINE NONLINEARITY DETECTION

BACKGROUND

1. Field

The present disclosure relates to a system and a method for detecting, in-situ, a cross-process linearity error in an image printing system that prints on an image bearing surface movable in the process direction.

2. Description of Related Art

Image printing systems in which a laser scan line is projected onto an image bearing surface to reproduce information are well known in the art. The image printing system typically uses a Raster Output Scanner (ROS) as a source of signals to be imaged on a pre-charged photoreceptor (e.g., a photosensitive plate, belt, or drum) for purposes of xerographic printing. The ROS provides a laser beam which switches on and off as it moves, or scans, across the photoreceptor. The surface of the photoreceptor is selectively discharged by the laser in locations to be printed, to form the desired image on the photoreceptor. The on-and-off control of the beam to create the desired latent image on the photoreceptor is facilitated by digital electronic data controlling the laser source. A common technique for affecting this scanning of the beam across the photoreceptor is to employ a rotating polygon surface. The laser beam from the ROS is reflected by the facets of the polygon creating a scanning motion of the beam, which forms a scan line across the photoreceptor. A large number of scan lines on a photoreceptor together form a raster of the desired latent image. Once a latent image is formed on the photoreceptor, the latent image is subsequently developed with a toner, and the developed image is transferred to a copy sheet, as in the well-known process of xerography.

A plurality of ROS units can be used in a color xerographic ROS printer. Each ROS forms a scan line for a separate color image on a common photoreceptor belt. Each color image is developed in overlying registration with the other color images from the other ROS units to form a composite color image which is transferred to an output sheet. Registration of each scan line of the plurality of ROS units requires each image to be registered to within a 0.1 mm circle or within a tolerance of +/−0.05 mm.

A typical prior art raster output scanning system 10 of FIG. 1 includes a light source 12 for generating a light beam 14 and scanning means 16 for directing the light beam 14 to a spot 18 at a photosensitive medium 20. The scanning means 16 also serves to move the spot 18 along a scan line 22 of specified length at the photosensitive medium 20. For that purpose, the scanning means 16 in the illustrated scanner system 10 includes a rotatable polygon mirror with a plurality of light reflecting facets 24 (eight facets being illustrated) and other known mechanical components that are depicted in FIG. 1 by the polygon 16 rotating about a rotational axis 26 in the direction of an arrow 28.

The light source, 12, such as a laser diode, emits a modulated coherent light beam 14 of a single wavelength. The light beam 14 is modulated in conformance with the image information data stream contained in the video signal sent from image output light source control circuit 30 to the light source 12.

The modulated light beam 14 is collimated by a collimating lens 32, then focused by a cross-scan cylindrical lens 34 to form a line on a reflective facet 24 of the rotating polygon mirror 16.

The polygon mirror 16 is rotated around its axis of rotation by a conventional motor (not shown), known to those of ordinary skill in the art.

The beam 14 reflected from the facet 24 then passes through the f-theta scan lenses 36 and the anamorphic wobble correction lens 38.

The f-theta scan lens 36 consists of a negative plano-spherical lens 40, a positive plano-spherical lens 42, and the cross-scan cylinder lens 44. This configuration of f-theta scan lenses has sufficient negative distortion to produce a linear scan beam. The light beam will be deflected at a constant angular velocity from the rotating mirror which the f-theta scan lens optically modifies to scan the surface at a constant linear velocity.

The f-theta scan lens 36 will focus the light beam 14 in the scan plane onto the scan line 22 on the photosensitive medium 20.

After passing through the f-theta scan lens 36, the light beam 14 then passes through a wobble correction anamorphic lens element 38. The wobble correction optical element can be a lens or a mirror and is sometimes referred to as the "motion compensating optics". The purpose of optical element 38 is to correct wobble along the scan line generated by inaccuracies in the polygon mirror/motor assembly.

The wobble correction lens 38 focuses the light beam in the cross-scan plane onto the scan line 22 on the photosensitive medium 20.

As the polygon 16 rotates, the light beam 14 is reflected by the facets 24 through the f-theta and wobble correction lenses and scans across the surface of the photosensitive medium in a known manner along the scan line 22 from a first end 46 of the scan line 22 (Start of Scan or "SOS") past a center (the illustrated position of the spot 18) and on to a second end 48 of the scan line 22 (End of Scan or "EOS"). The light beam exposes an electrostatic latent image on the photosensitive member 20. As the polygon 16 rotates, the exposing light beam 14 is modulated by circuit 30 to produce individual bursts of light that expose a line of individual pixels, or spots 18, on the photosensitive member 20.

Ideally, the ROS should be capable of exposing a line of evenly spaced, identical pixels on the photosensitive medium 20. However, because of the inherent geometry of the optical system of the ROS, and because manufacturing errors can cause imperfections in the facets of a polygon mirror, obtaining evenly spaced, identical pixels can be problematic.

"Scan non-linearity" refers to variations in spot velocity occurring as the spot moves along the scan line during the scan cycle. Scan linearity is the measure of how equally spaced the spots are written in the scan direction across the entire scan line. Typical scan linearity curves start at zero position error at one end of a scan having a positive lobe of position error across the scan line, cross the center of scan with zero position error and then have a negative lobe of position error across the remainder of the scan line toward the other end of the scan. Scan linearity curves may have image placement errors of zero at several locations across the scan line. Ideally, the curve would be at zero across the entire scan line.

The shape of the non-linearity signature varies from ROS to ROS and can thus cause misregistration between colors in a multiple ROS laser printer. When printing multi-color documents it is important to keep the colors aligned.

FIG. 2 shows a scan line 100 consisting of a series of pixels 102 uniformly spaced 104 by the pixel clock of the raster output scanning system. These pixels 102 on the scan line 100 are placed on a uniform grid 106 at each clock cycle to form the idealized, perfect scan linearity.

In practice, the raster output scanning system has a small non-linearity, which causes deviations from the uniform grid. This departure from uniform pixel placement along the scan line is referred to as scan non-linearity. FIG. 3 shows deviation from the uniform pixel placement of FIG. 2 due to scan non-linearity. The scan line 200 consists of a series of pixels 202 which are displaced by a distance 204 from the uniform pixel placement 206 along the scan line as shown schematically in the graph of FIG. 4. The inherent scan non-linearity in the ROS if uncorrected will improperly space pixels along the scan line direction.

Scan non-linearity is typically caused by system geometry or a velocity variation of the scanning means. The speed at which the focused exposing light beam travels across the scan line on the photosensitive medium 20 is called the spot velocity.

Without some means to correct for the inherent scan non-linearity caused by the geometry of the ROS system, the spot velocity will vary as the light beam scans across the photosensitive medium. A scanner having a multifaceted rotating polygon, for example, directs the light beam at a constant angular velocity. But the spot is farther from the polygon facets at the ends of the scan line than it is at the center and so the spot velocity will be higher towards the ends of the scan line, and lower towards the center of the scan line.

Since the scan non-linearity is repeatable for a given ROS, it can be measured and corrected for. Some raster output scanners compensate for such non-linearity electronically using a variable frequency pixel clock (e.g., a scanning clock). The pixel clock produces a pulse train (i.e., a pixel clock signal) that is used to turn the light beam emitted by the light source on and off at each pixel position along the scan line. Varying the clock frequency and thereby the timing of individual pulses in the pulse train serves to control pixel placement along the scan line. If the frequency of the pixel clock signal is constant, the resulting pixels will be positioned further apart at the edges of the photosensitive medium, and closer together towards the center of the photosensitive medium. That will more evenly space the pixels and thereby at least partially compensate for what is sometimes called pixel position distortion (i.e., uneven pixel spacing caused by scan-line non-linearity).

The light source control circuitry 30 serves as an electronic control system for controlling the light beam 14 in order to produce the pixels along the scan line 22. The control system may, for example, be configured using known components and design techniques to produce a control signal for activating the light beam at each of a plurality of desired pixel positions along the scan line (e.g., the central portion of each pixel position being evenly spaced at 1/300 inch intervals for 300 dpi resolution or being evenly spaced at 1/600 inch intervals for 600 dpi resolution).

Preferably, the control system is configured so that the control signal defines a pixel interval for each pixel position and so that the pixel interval defined by the control signal varies proportionately according to spot velocity, i.e., a higher frequency at the ends of the scan line than toward the center. For that purpose, the control system may synchronize the control signal with spot position by suitable known means, such as by responding to a start-of-scan (SOS) control signal or other synchronizing signal produced by known means, in order to vary the pixel interval according to spot velocity.

Other raster output scanners compensate for such non-linearity by manually measuring the amount of scan non-linearity of the ROS in manufacturing and applying a correction function. A second correction function (e.g., to account for any residual error from the manufacturing setup) can also be performed by a Field Service Engineer by making prints (e.g., that contains color registration targets) on a customer's machine and measuring the amount of non-linearity. The error from these prints is approximated using a polynomial whose coefficients are entered in non-volatile memory and corrected for by the software. This process is fairly labor intensive for the Field Service Engineer and is prone to error.

U.S. Pat. No. 6,178,031, herein incorporated by reference, discloses a method of calculating pixel clock frequency shifts to correct non-linearity of a scan line in a ROS. The frequency shift is calculated from a data smoothing polynomial curve for non-linear positions of pixels along the scan line in the ROS. In this method, the measurement of the amount of non-linearity is recorded on a sheet of paper and is manually entered into or scanned by a system to determine the amount of non-linearity. This patent, however, does not disclose automatically detecting and measuring the non-linearities of the scan line.

SUMMARY

In one embodiment, a method for correcting a cross-process linearity error in an image printing system that prints on an image bearing surface movable in the process direction is provided. The method includes placing marking material to form a row of registration marks on the image bearing surface, detecting a position in a cross-process direction of each registration mark in the row using a linear array sensor that extends in the cross-process direction, and determining a correction function with a processor using the positions of the registration marks as detected by the linear array sensor to compensate for an error in the positions in the cross-process direction of the registration marks. The row of registration marks extends in the cross-process direction transverse to the process direction.

In another embodiment, an image printing system for correcting a cross-process linearity error is provided. The image printing system includes a print engine, a linear array sensor, and a processor. The print engine is configured to place marking material to form a row of registration marks on an image bearing surface that is movable in a process direction. The row of registration marks extends in a cross-process direction transverse to the process direction. The linear array sensor is extending in the cross-process direction and is adjacent to the image bearing surface. The linear array sensor is configured to detect a position in the cross-process direction of each registration mark in the row. The processor is configured to determine a correction function using the positions of the registration marks as detected by the linear array sensor to compensate for an error in the positions in the cross-process direction of the registration marks.

Other objects, features, and advantages of one or more embodiments will become apparent from the following detailed description, and accompanying drawings, and the appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

The present disclosure proposes a method for correcting a cross-process linearity error in an image printing system 110 that prints on an image bearing surface 112 movable in the process direction. In particular, the present disclosure provides an in situ method for detecting and providing the measurements of the amount of non-linearity to any system that calculates a correction function (e.g., data smoothing polynomial curve) to correct the scan non-linearity. (See e.g., the correction function in the above incorporated U.S. Pat. No. 6,178,031). The present disclosure uses a linear array sensor to detect in situ, thereby providing an automatic correction process to correct the cross-process linearity error. The automated process provided in the present disclosure may also be used as a diagnostic or setup tool that may be run continuously.

Figure 1:
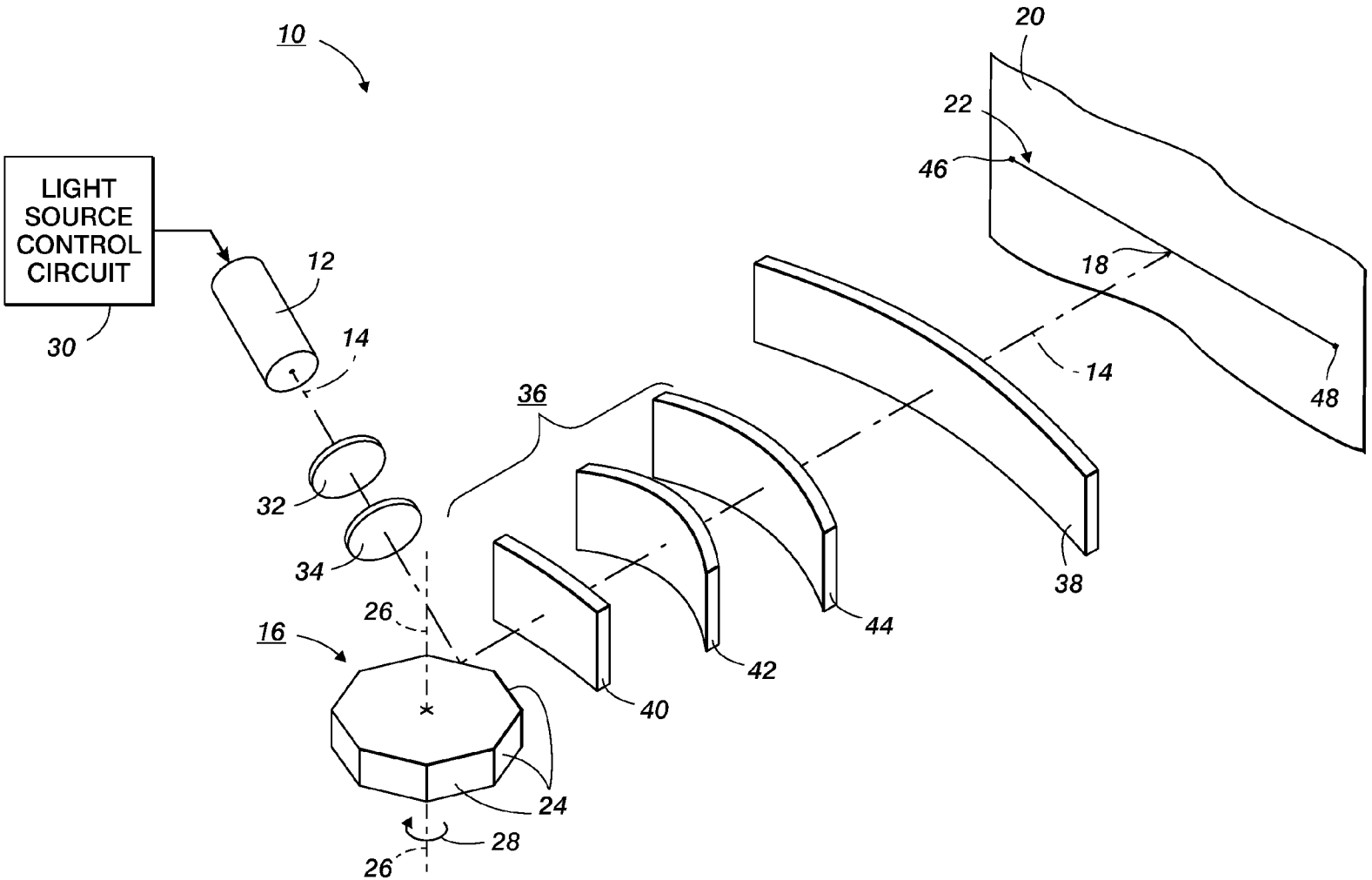
FIG. 1 PRIOR ART
FIG. 1 shows a schematic side view of a raster output scanning (ROS) system.
Figure 2:
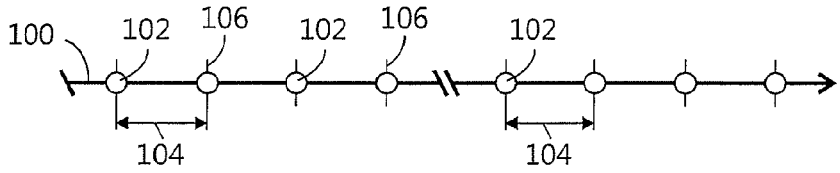
FIG. 2 (Prior Art)
FIG. 2 shows an idealized pixel placement along a scan line.
Figure 3:
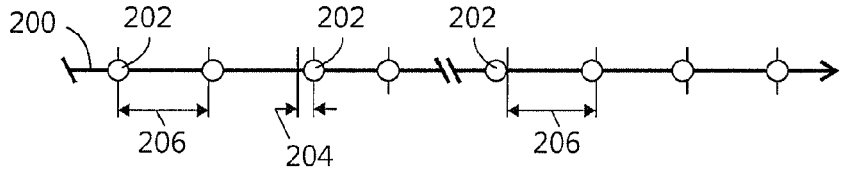
FIG. 3 (Prior Art)
FIG. 3 shows a non-linear pixel placement along a scan line.
Figure 4:
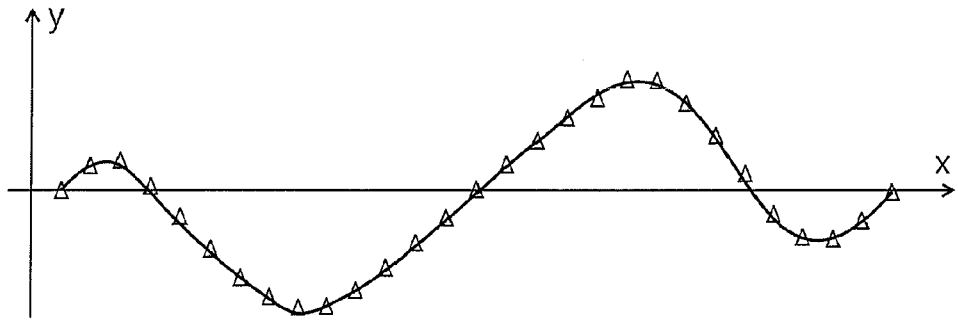
FIG. 4 (Prior Art)
FIG. 4 shows graph measuring scan non-linearity of the pixel placement of FIG. 3.
Figure 5:
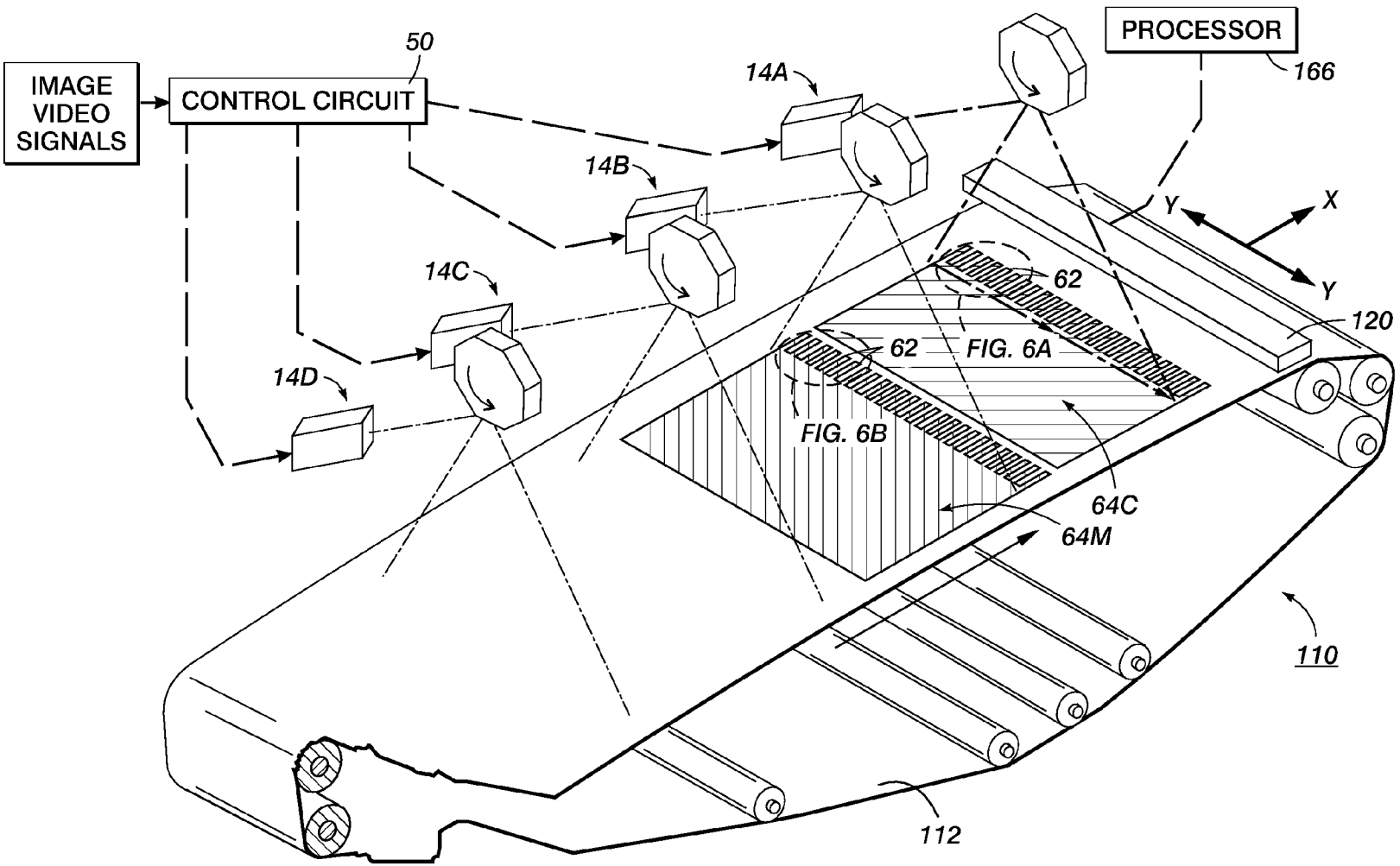
FIG. 5 shows a simplified schematic perspective view of part of an image printing system for better illustrating exemplary sequential ROS generation of plural color latent images and associated exemplary latent image registration marks for sensing by a linear array sensor (with development stations, etc., removed for illustrative clarity)

Referring to FIG. 5, the method includes placing a marking material to form a row 60 of registration marks 62 on the image bearing surface 112, detecting a position in a cross-process direction of each registration mark 62 in the row 60 using a linear array sensor 120 that extends in the cross-process direction, and determining a correction function using the positions of the registration marks 62 to compensate for an error in the positions in the cross-process direction of the registration marks 62.

FIG. 5 shows a partial, very simplified, schematic perspective view of a printer 110. The printer 110 is one example of an otherwise known type of xerographic, plural color "image-on-image" (IOI) type full color (cyan, magenta, yellow and black imagers) reproduction machine, merely by way of one example of the applicability of the present disclosure. This particular type of printing is also referred as "single pass" multiple exposure color printing. The printer typically uses a Raster Output Scanner (ROS) to expose the charged portions of an image bearing surface to record an electrostatic latent image on the image bearing surface. Further examples and details of such IOI systems are described in U.S. Pat. Nos. 4,660,059; 4,833,503; and 4,611,901, each of which are incorporated herein by reference. U.S. Pat. No. 5,438,354, the entirety of which are incorporated herein by reference, provides a Raster Output Scanner (ROS) system.

However, it will be appreciated that the present disclosure could also be employed in non-xerographic color printers, such as ink jet printers, or in "tandem" xerographic or other color printing systems, typically having plural print engines transferring respective colors sequentially to an intermediate image transfer belt and then to the final substrate. Thus, for a tandem color printer (e.g., U.S. Pat. Nos. 5,278,589; 5,365,074; 6,904,255 and 7,177,585, each of which are incorporated herein by reference) it will be appreciated that the image bearing surface on which the subject registration marks are formed may be either or both on the photoreceptors and the intermediate transfer belt, and have linear array sensors and image position correction systems appropriately associated therewith. Various such known types of color printers are further described in the above-cited patents and need not be further discussed herein.

The image printing system 110 generally has two important dimensions: the process (or slow scan) direction and the cross-process (or fast scan) direction. The direction in which the image bearing surface 112 moves is referred to as process (or slow scan) direction, and the direction that is transverse or perpendicular to the process direction (e.g., in which the plurality of sensors are oriented) is referred to as cross-process (or fast scan) direction. In the illustrated embodiment, the X-direction represents process (or slow scan) direction and the Y-direction represents cross-process (or fast scan) direction.

A single image bearing surface 112 may be successively charged, ROS imaged, and developed with black or any or all primary colors toners by a plurality of imaging stations. In this example, these plural imaging stations include respective ROS's 14A, 14B, 14C, 14D, and 14E; and associated developer units (not shown). A composite plural color imaged area 130, as shown in FIG. 5, may thus be formed in each desired image area in a single revolution of the image bearing surface 112 with this exemplary printer 110, providing accurate registration.

In one embodiment, the image bearing surface 112 is at least one of a photoreceptor drum, a photoreceptor belt, an intermediate transfer belt, an intermediate transfer drum, and other image bearing surfaces. That is, the term image bearing surface means any surface on which a toner image is received, and this may be an intermediate surface (i.e., a drum or belt on which an image is formed prior to transfer to a printed document).

In one embodiment, a plurality of color images are printed on the image bearing surface 112, where the plurality of color images are color separations of a color model that are accurately superimposed to form full color images. In one embodiment, these color images are developed successively on the image bearing surface 12 before being transferred to a sheet of paper. The cross-process linearity error is corrected for each color image.

The present disclosure describes an image printing system 110 using a CMYK (cyan, magenta, yellow, black) color model, where each color separation (e.g., Cyan, Magenta, Yellow and Black) of the CMYK color model includes a ROS. However, it is contemplated that the present disclosure is not limited to CMYK color model. In one embodiment, the color model is selected from the group consisting of RGB (red, green, blue) color model, CMY (cyan, magenta, yellow) color model, CMYK (cyan, magenta, yellow, black) color model, HSB (Hue, Saturation, Brightness) color model, HLS (Hue, Lightness, Saturation) color model, and CIE L*a*b (Lab) color model.

As noted earlier, the row 60 of registration marks 62 is placed (e.g., using a marking material) on the image bearing surface 112. The row 60 of registration marks 62 extends in the cross-process direction transverse to the process direction. In illustrated embodiment, the row 60 of registration marks 62 is placed along the width of the image bearing surface 112. In one embodiment, the row 60 of registration marks 62 is placed adjacent to a toner image 64C or 64M (e.g., corresponding to cyan and magenta color separations of the CMYK color model) on the image bearing surface 112.

Figure 6A:
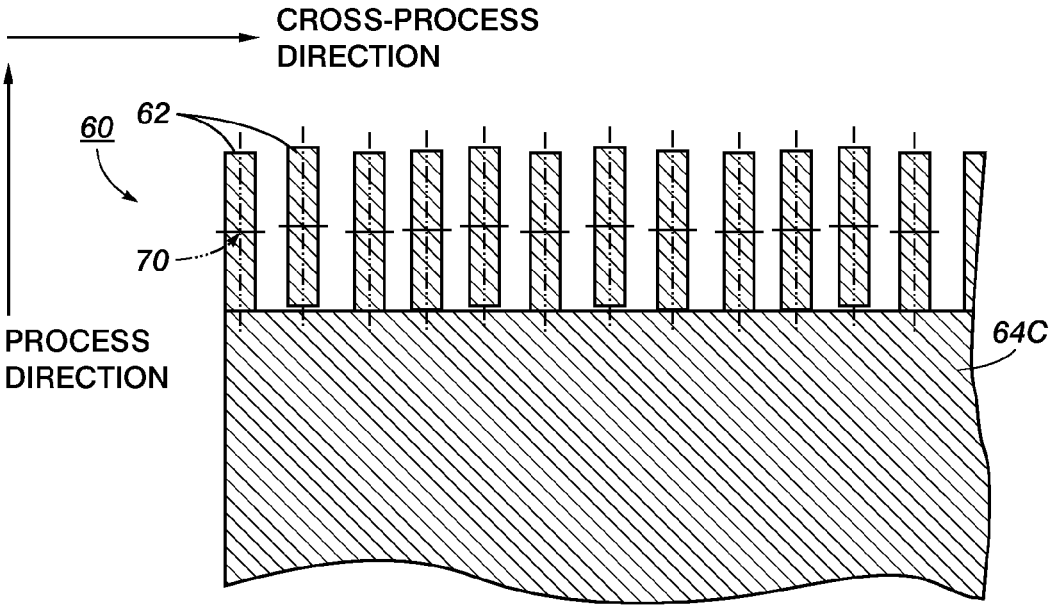
FIG. 6A shows a detailed view of registration marks and toner image for cyan color separation of the CMYK color model in accordance with an embodiment of the present disclosure.
Figure 6B:
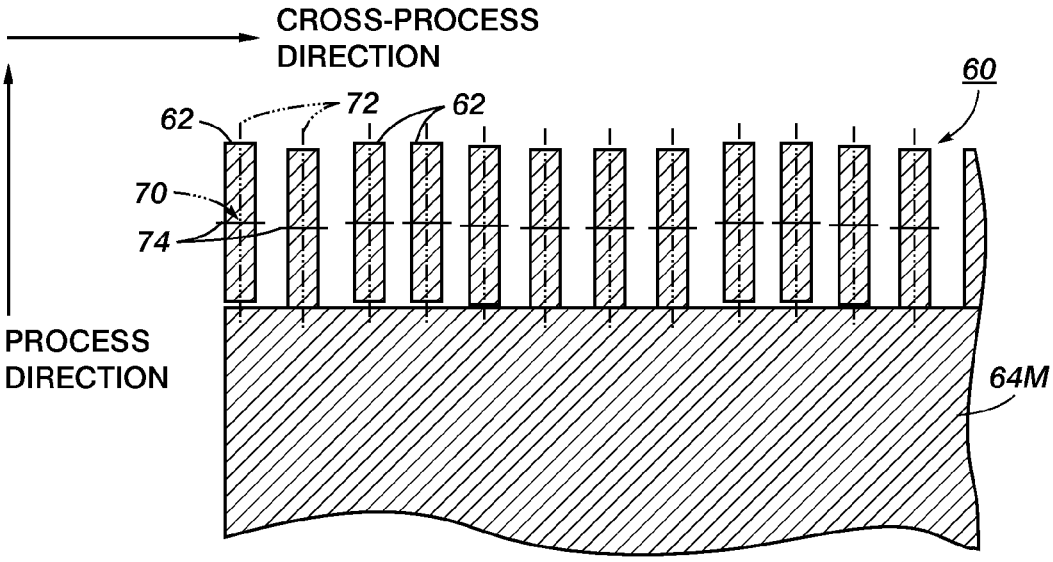
FIG. 6B shows a detailed view of registration marks and toner images for magenta color separation of the CMYK color model in accordance with an embodiment of the present disclosure.

In the illustrated embodiment, as shown in FIGS. 6A and 6B, the geometric center of each registration mark 62 is indicated by cross-hairs 70, which are not printed, but calculated as part of the correction algorithm. In another embodiment, the particular shape of the registration marks is not important to the present disclosure. These registration marks are used to determine the correction function that is used to compensate the error in the positions of the registration marks and, thus, correct the scan non-linearity of Raster Output Scanner (ROS).

As noted earlier, the position in the cross-process direction of each registration mark 62 is detected using a linear array sensor 120. In one embodiment, the position in the cross-process direction of each registration mark 62 is determined at the intersection of straight lines 72 and 74 (i.e., line centers) of the cross mark 70. In the present disclosure, the positions in the cross-process direction of each registration mark 62 are used to determine the correction function that is used to correct the scan non-linearity of ROS. In one embodiment, the geometric centers of each registration mark 62 are calculated to the nearest 1/12 of a pixel as measured by the linear array sensor 120.

Preferably, the linear array sensor 120 is, for example, a full width array (FWA) sensor. A full width array sensor is defined as a sensor that extends substantially an entire width (e.g., perpendicular to a direction of motion) of the moving image bearing surface 112. In one embodiment, the linear array sensor 120 is extending in the cross-process direction. In one embodiment, the full width array sensor is configured to detect any desired part of the printed image, while printing real images. The full width array sensor may include a plurality of sensors equally spaced at intervals (e.g., every 1/600th inch (600 spots per inch)) in the cross-process (or a fast scan) direction. See for example, U.S. Pat. No. 6,975,949, incorporated herein by reference. It is understood that other linear array sensors may also be used, such as contact image sensors, CMOS array sensors or CCD array sensors. Although the full width array sensor or contact sensor is shown in the illustrated embodiment, it is contemplated that the present disclosure may use sensor chips that are significantly smaller than the width of the image bearing surface, through the use of reductive optics. In one embodiment, the sensor chips may be in the form of an array that is one or two inches long and that manages to detect the entire area across the image bearing surface through reductive optics. In one embodiment, a processor may be provided to both calibrate the linear array sensor and to process the reflectance data detected by the linear array sensor. It could be dedicated hardware like ASICs or FPGAs, software, or a combination of dedicated hardware and software.

Figure 7:
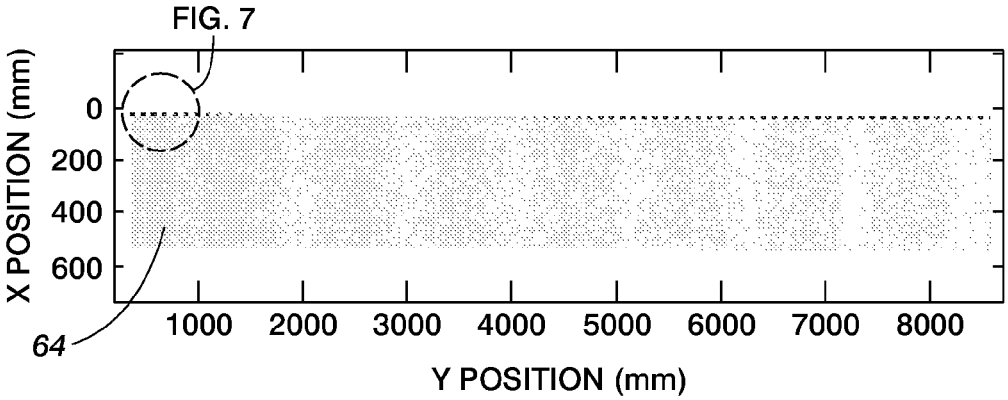
FIG. 7 shows a toner image with a row of registrations marks adjacent the tone image in accordance with an embodiment of the present disclosure.
Figure 8:
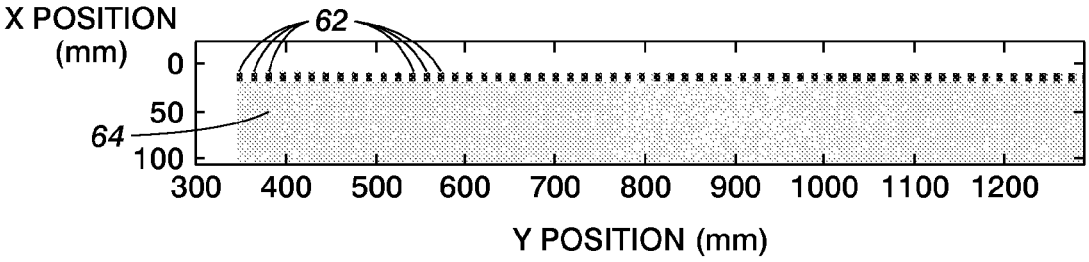
FIG. 8 shows a detailed view of a portion of the toner image with the row of registrations marks adjacent the toner image in accordance with an embodiment of the present disclosure.

FIG. 7 shows a toner image with a row 60 of registration marks 62 adjacent to toner image 64, and FIG. 8 shows a detailed view of a portion of the toner image 64 with the row 60 of the registration marks 62. In one embodiment, the present disclosure uses a toner image 64 (e.g., test pattern corresponding to a color image) to aid in measuring the scan non-linearity of each ROS. Each toner image 64 includes a plurality of registration marks 62 located at the top of the toner image 64. In one embodiment, these registration marks 62 are configured to indicate to the signal processing code where the toner image 64 begins on the image bearing surface 112 (as shown in FIG. 5). In one embodiment, an eight-on/eight-off pattern along the cross-process direction may include five hundred and sixteen (516) registration marks. In one embodiment, a scan bar is used to capture an image of these registration marks 62. In one embodiment, the spacing between line centers of the registration marks 62 captures the linearity characteristics of the ROS in an automated fashion.

In one embodiment, a processor 66 is configured to process the data received from the linear array sensor 120 and to determine the correction function using the positions in the cross-process direction of the registration marks 62. The correction function is configured to compensate for an error in the positions in the cross-process direction of the registration marks 62. The error is between the desired positions in the cross-process direction of the registration marks (e.g., where they should have been placed) and the actual positions in the cross-process direction of the registration marks (e.g., where they were actually placed).

In one embodiment, the correction function includes a data smoothing polynomial curve that is curve fit on the positions in the cross-process direction of the registration marks. In one embodiment, the cross-process coordinates of each line center of the registration marks may be curve fit to a polynomial to characterize the non-linearity of each ROS. The data smoothing polynomial curve is of a sixth or higher order. The data smoothing polynomial curve is configured to pass through all the positions in the cross-process direction of the registration marks. In one embodiment, the data smoothing procedure includes forcing a polynomial to zero at the ends of active scan. In general, a secondary advantage to the polynomial fit is the ability to take data with one size of sampling interval (sampling rate) and to utilize the data with a different sampling interval (sampling rate).

In one embodiment, the data smoothing polynomial curve is curve fit on a set of average positions of the registration marks for each color image. Each average position is an average of a set of positions of the plurality of registration marks within each color image. The positions in the cross-process direction within each color can be averaged to determine the average position of each color at two (lateral or cross-process positions) or more positions along the toner image. In one embodiment, any averaging technique as would be appreciated by one skilled in the art may be used. For example, the first ten registration marks in the lateral side for Cyan may be averaged to determine an average position in the cross-process direction for Cyan on one lateral side. Similarly, the last ten registration marks in the other lateral side for Cyan may be averaged to determine an average position in the cross-process direction for Cyan on the other lateral side.

In one embodiment, the sixth order iteration of the correction function is in the form of the following equation.

$$y=a_0+a_1x+a_2x^2+a_3x^3+a_4x^4+a_5x^5$$

where y represents the scan linearity;

x represents the scan distance for the pixels (e.g., the positions of the registration marks in the cross-process direction) along the scan line; and $a_0$-$a_5$ represent the coefficients of the correction function.

In one embodiment, the coefficients ($a_0$-$a_5$) are calculated by performing a sixth order least squares fit of the error between the desired positions in the cross-process direction of the registration marks (e.g., where they should have been placed) and the actual positions in the cross-process direction of the registration marks (e.g., where they are actually placed).

In one embodiment, the polynomial curve can be fit to the positions in the cross-process direction of the registration marks by a technique such as least squares regression and to force the end points start-of-scan (SOS) and end-of-scan (EOS) to be zero by either weighting or by a piecewise polynomial fit. In one embodiment, the polynomial curve can be fitted to the positions in the cross-process direction of the registration marks by other techniques, for example, Givnes, Householder, and Cholesky.

In one embodiment, the correction function includes a frequency shift calculation to a sixth or higher order polynomial. The correction function or the frequency shift calculation is then be applied to the light source control circuitry that generates the pixel clock frequency. The pixels will then be placed with equal spacing across the active scan line of the ROS by modulation of the light beam emitted by the light source in response to the shifted frequency from the pixel clock. In one embodiment, a frequency modulation of a nominal pixel clock frequency is performed to correct for the scan non-linearity.

EXAMPLE

If registration marks are to be imaged by a ROS at the following locations from an edge of a paper (e.g., measured in inches)

| A | B | C | D | ... | Y | Z |
|---|---|---|---|---|---|---|
| 1.0 | 1.5 | 2.0 | 2.5 | ... | 9.5 | 10.0 |

The scan non-linearity error in the ROS may cause the registration marks to be imaged at the following locations from the edge of the paper (in inches)

| A | B | C | D | ... | Y | Z |
|---|---|---|---|---|---|---|
| 1.1 | 1.45 | 2.01 | 2.61 | ... | 9.49 | 9.95 |

Using the present disclosure the positions in the cross-process direction of the registration marks (e.g., A-Z) on the image bearing surface can be detected using the linear array sensor. The error between the desired positions in the cross-process direction of the registration marks (e.g., where they should have been placed) and the actual positions in the cross-process direction of the registration marks (e.g., where they are actually placed) is characterized by a correction function (e.g., a polynomial curve). The correction function is then integrated into a controller of the ROS. When imaging the pixels (e.g., registration marks) along the scan line, the controller compensates for the error and thus corrects the scan non-linearity.

For example, consider the second registration mark, B in the above example. The second registration mark, B is actually placed at 1.45 inches from the paper edge because of the scan non-linearity of the ROS but the second registration mark, B should have been placed at a location of 1.5 inches from the paper edge. Using the present disclosure, the correction function in the controller of the ROS waits a little bit longer (e.g., as the laser beam of the ROS scans from the lateral end to the other lateral end) before imaging the second registration mark, B because there is a known error of 0.05 inches.

While the present disclosure has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the disclosure following, in general, the principles of the disclosure and including such departures from the present disclosure as come within known or customary practice in the art to which the disclosure pertains, and as may be applied to the essential features hereinbefore set forth and followed in the spirit and scope of the appended claims.

What is claimed is:

1. A method for correcting a cross-process linearity error in an image printing system that prints on an image bearing surface movable in a process direction, the method comprising:

placing marking material to form a row of registration marks on the image bearing surface, wherein the row of registration marks extends in a cross-process direction transverse to the process direction;

detecting a position in the cross-process direction of each registration mark in the row using a linear array sensor extending in the cross-process direction; and determining with a processor a correction function using the positions in the cross-process direction of the registration marks as, detected by the linear array sensor to compensate for an error in the positions in the cross-process direction of the registration marks.

2. The method of claim 1, wherein the image bearing surface is at least one of a photoreceptor drum, a photoreceptor belt, an intermediate transfer belt, an intermediate transfer drum, and other image bearing surfaces.

3. The method of claim 1, wherein the linear array sensor is a full width array (FWA) sensor.

4. The method of claim 1, wherein the correction function is integrated into a controller of a Raster Output Scanner to correct the cross-process linearity error.

5. A method for correcting a cross-process linearity error in an image printing system that prints on an image bearing surface movable in a process direction, the method comprising:

placing marking material to form a row of registration marks on the image bearing surface, wherein the row of registration marks extends in a cross-process direction transverse to the process direction;

detecting a position in the cross-process direction of each registration mark in the row using a linear array sensor extending in the cross-process direction; and determining with a processor a correction function using the positions of the registration marks as detected by the linear array sensor to compensate for an error in the positions in the cross-process direction of the registration marks, wherein the correction function comprises a data smoothing polynomial curve that is curve fit on the positions in the cross-process direction of the registration marks.

6. The method of claim 5, the data smoothing polynomial curve is a sixth or higher order iteration.

7. The method of claim 5, wherein a plurality of color images are printed on the image bearing surface, and wherein the plurality of color images are color separations of a color model being accurately superimposed to form full color images.

8. The method of claim 7, wherein the cross-process linearity error is corrected for each color image.

9. The method of claim 7, wherein the data smoothing polynomial curve is curve fit on a set of average positions of the registration marks for each color image, wherein each average position is an average of a set of positions of the plurality of registration marks within each color image.

10. A method for correcting a cross-process linearity error in an image printing system that prints on an image bearing surface movable in a process direction, the method comprising:

placing marking material to form a row of registration marks on the image bearing surface, wherein the row of registration marks extends in a cross-process direction transverse to the process direction;

detecting a position in the cross-process direction of each registration mark in the row using a linear array sensor extending in the cross-process direction; and determining with a processor a correction function using the positions of the registration marks as detected by the linear, array sensor to compensate for an error in the positions in the cross-process direction of the registration marks, wherein each registration mark comprises a cross mark comprising two straight lines intersecting each other at right angles, wherein the position in the cross-process direction of each registration mark is determined at the intersection of the two straight lines of the cross mark.

11. An image printing system for correcting a cross-process linearity error, the system comprising:

a print engine configured to place marking material to form a row of registration marks on an image bearing surface movable in a process direction, wherein the row of registration marks extends in a cross-process direction transverse to the process direction;

a linear array sensor adjacent to the image bearing surface and extending in the cross-process direction, wherein the linear array sensor configured to detect a position in the cross-process direction of each registration mark in the row; and a processor configured to determine a correction function using the positions in the cross-process direction of the registration marks as detected by the linear array sensor to compensate for an error in the positions in the cross-process direction of the registration marks.

12. The system of claim 11, wherein the image bearing surface is at least one of a photoreceptor drum, a photoreceptor belt, an intermediate transfer belt, an intermediate transfer drum, and other image bearing surfaces.

13. The system of claim 11, wherein the linear array sensor is a full width array (FWA) sensor.

14. The system of claim 11, wherein the correction function is integrated into a controller of a Raster Output Scanner to correct the cross-process linearity error.

15. An image printing system for correcting a cross-process linearity error, the system comprising:

a print engine configured to place marking material to form a row of registration marks on an image bearing surface movable in a process direction, wherein the row of registration marks extends in a cross-process direction transverse to the process direction;

a linear array sensor adjacent to the image bearing surface and extending in the cross-process direction, wherein the linear array sensor configured to detect a position in the cross-process direction of each registration mark in the row; and a processor configured to determine a correction function using the positions of the registration marks as detected by the linear array sensor to compensate for an error in the positions in the cross-process direction of the registration marks, wherein the correction function comprises a data smoothing polynomial curve that is curve fit on the positions in the cross-process direction of the registration marks.

16. The system of claim 15, the data smoothing polynomial curve is a sixth or higher order iteration.

17. The system of claim 15, wherein a plurality of color images are printed on the image bearing surface, and wherein the plurality of color images are color separations of a color model being accurately superimposed to form full color images.

18. The system of claim 17, wherein the cross-process linearity error is corrected for each color image.

19. The system of claim 17, wherein the data smoothing polynomial curve is curve fit on a set of average positions of the registration marks for each color image, wherein each average position is an average of a set of positions of the plurality of registration marks within each color image.

20. An image printing system for correcting a cross-process linearity error, the system comprising:

a print engine configured to place marking material to form a row of registration marks on an image bearing surface movable in a process direction, wherein the row of registration marks extends in a cross-process direction transverse to the process direction;

a linear array sensor adjacent to the image bearing surface and extending in the cross-process direction, wherein the linear array sensor configured to detect a position in the cross-process direction of each registration mark in the row; and a processor configured to determine a correction function using the positions of the registration marks as detected by the linear array sensor to compensate for an error in the positions in the cross-process direction of the registration marks, wherein each registration mark comprises a cross mark comprising two straight lines intersecting each other at right angles, wherein the position in the cross-process direction of each registration mark is determined at the intersection of the two straight lines of the cross mark.

* * * * *